United States Patent [19]

McCarty

[11] 4,285,210

[45] Aug. 25, 1981

[54] SELF-CONTAINED HEATING AND COOLING APPARATUS

[75] Inventor: William J. McCarty, Louisville, Ky.

[73] Assignee: General Electric Company, Louisville, Ky.

[21] Appl. No.: 144,795

[22] Filed: Apr. 28, 1980

[51] Int. Cl.[3] ..... F25B 29/00; F25B 13/00

[52] U.S. Cl. ..... 62/325; 62/160

[58] Field of Search ..... 62/325, 140, 160

[56] References Cited

U.S. PATENT DOCUMENTS

| | | | |
|---|---|---|---|
| 2,391,151 | 12/1945 | Gibson | 62/325 |
| 2,878,657 | 3/1959 | Atchison | 62/325 |
| 2,975,611 | 3/1961 | Pietsch | 62/325 X |
| 3,370,437 | 2/1968 | Jacobs | 62/160 |
| 3,511,060 | 5/1970 | Bodcher | 62/140 |
| 3,555,842 | 1/1971 | Bodcher | 62/140 |
| 3,871,187 | 3/1975 | Skvarenina | 62/196 |
| 4,027,497 | 6/1977 | Thurman | 62/156 |
| 4,158,950 | 6/1979 | McCarty | 62/278 |

*Primary Examiner*—Lloyd L. King

*Attorney, Agent, or Firm*—Frank P. Giacalone; Radford M. Reams

[57] ABSTRACT

A reverse air cycle type heat pump is provided that utilizes unidirection refrigerant flow wherein the condenser and evaporator retain their functions, but the air directed across them is redirected for different operations. The air cycle type heat pump is further provided with a secondary defrost circuit including valves which permit refrigerant flow to by-pass the compressor and the expansion device only when compressor operation terminates and the system pressure differential is equalized. This defrost circuit causes the relatively warm refrigerant in gaseous phase in the condenser to displace the relatively cold refrigerant in liquid phase in the evaporator with the flow continuing until the defrost system is completed.

4 Claims, 3 Drawing Figures

SELF-CONTAINED HEATING AND COOLING APPARATUS

BACKGROUND OF THE INVENTION

The reverse air cycle type of heat pump utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquifying the refrigerant and outside again; and indoor air is passed in heat exchange relationship with the evaporator for cooling the air circulated again. Conversely, in the heating mode, outdoor air passes in heat exchange relationship with the evaporator for vaporizing the refrigerant, then outside again; and indoor air is passed in heat exchange relationship with the evaporator for vaporizing the refrigerant, then outside again; and indoor air is passed in heat exchange relationship with the condenser for heating the air and circulated again.

One prior art U.S. Pat. No. 2,878,657-Atchison, assigned to General Electric Company, the assignee of the present invention, discloses a heat pump wherein the air conditioning unit includes a plurality of air controlling valves each of which is associated with an opposed inlet and outlet opening of the units that permit selective control of the air flowing into the discharging from the unit in order to direct air either from the outside or from within the enclosure over either of the heat exchangers disposed within separate compartments of the unit.

Under certain operating conditions in the heating cycle, evaporator may operate at such low outdoor ambient temperatures as to cause the accumulation of a coating or layer of frost on its surface. Since frost when it accumulates operates as a barrier to heat transfer between the evaporator and the air being circulated thereover, the efficiency of the unit is markedly reduced. Further, unless means are provided for interrupting the accumulation of frost, the evaporator can become completely filled with a layer of frost that may effectively block air passage therethrough. This blockage of air results in the loss of heat exchange and if allowed to continue can cause refrigeration system components to fail and can also result in compressor burn-out unless compressor operation is terminated.

The shutting down of compressor operation each time frost accumulates severely curtails the operation of the unit in the heating cycle and accordingly the efficiency of the unit as a heating means at temperatures below the evaporator frosting level.

In U.S. Pat. No. 3,555,842-Bodcher, a defrost line connects the upper inlet of the condenser to the upper inlet of the evaporator and includes a defrost valve which is closed during operation of the compressor but opens when compressor operation terminates. A return line connects the evaporator collector with the lower part of the condenser and includes a valve which operates in the same manner as the defrost valve.

In U.S. Pat. No. 4,158,950-McCarty, assigned to the General Electric Company, assignee of the present invention, there is disclosed a defrost arrangement for refrigeration system of the reverse cycle. A secondary defrost circuit is provided which permits refrigerant flow to by-pass the compressor when compressor operation terminates.

SUMMARY OF THE INVENTION

The present invention provides an air conditioning apparatus for conditioning air in an enclosure having a wall opening, and more particularly to an air conditioner including a housing adapted to be positioned in the wall opening with one side of said housing facing the outdoors and the opposite side of the housing facing said enclosure. A central chamber is defined by spaced partitions dividing the housing into an evaporator compartment and a condenser compartment.

A refrigerator system of the type having a refrigerant capable of boiling under relatively low pressure to absorb heat and condensing under relatively high pressure to expel heat, a compressor for compressing a refrigerant fluid in gaseous phase having a high pressure outlet port and a low pressure inlet port, a condenser in said condenser compartment having a high pressure inlet port and a high pressure liquid refrigerant outlet port, means connecting said inlet port to said compressor outlet, an evaporator in said evaporator compartment having a low pressure liquid inlet port in fluid communication with said high pressure liquid refrigerant outlet port of said condenser by a fluid line, and having a low pressure outlet port at its upper portion, means connecting said outlet port with said inlet port of said compressor, and a flow control means in said fluid line.

Positioned in each of the compartments is a fan shroud that substantially divides the evaporator and condenser compartments into inlet and outlet sections, each of the sections having an opening in both the indoor and outdoor facing side of the housing. A fan is positioned in each of the shrouds for circulating air through the evaporator and condenser compartments in a direction from the inlet section to the outlet section. Movable air valve means are provided for controlling the flow of air through the evaporator and condenser compartments for heating or cooling the enclosure. The air valve means include a first damper slidably arranged in the indoor facing side of the housing that is associated with the indoor facing openings of the compartments and a second damper slidably arranged in the outdoor facing side of the housing that is associated with the outdoor facing opening of the compartments. The dampers are selectively positioned to a first cooling position wherein the indoor facing openings of the evaporator compartment communicate with the enclosure and the outdoor facing openings of the condenser compartment communicate with the outdoors for cooling the enclosure air, and to a second heating position wherein the indoor facing openings in the condenser compartment communicate with the enclosure for heating the air.

The refrigerator system includes defrost means including a first defrost flow passage connected between the low pressure outlet port of the evaporator and the high pressure inlet of said condenser, and a second defrost flow passage connected between the high pressure outlet of the condenser and the low pressure inlet of said evaporator, each of the defrost flow passages are provided with a valve.

The valve means are operable for holding the valves in their closed position when a refrigerant pressure differential is present in the system and being operable to an open position when the pressure differential is bled down through the flow control means after the compressor operation terminates, so that a non-restrictive refrigerant defrost flow path circuit is established through the first defrost flow passage between the upper portions of the condenser and evaporator and through the second defrost flow passage between the lower portion of condenser and evaporator, thereby allowing liquid refrigerant when present in the lower portion of the evaporator to flow through the second defrost flow passage into the lower portion of the condenser, while the warmer gaseous refrigerant when present in the condenser will flow through the first defrost flow passage into the upper portion of the evaporator to raise the temperature of the evaporator and melt frost when present.

DESCRIPTION OF THE PREFERRED EMBODIMENT

Figure 1:
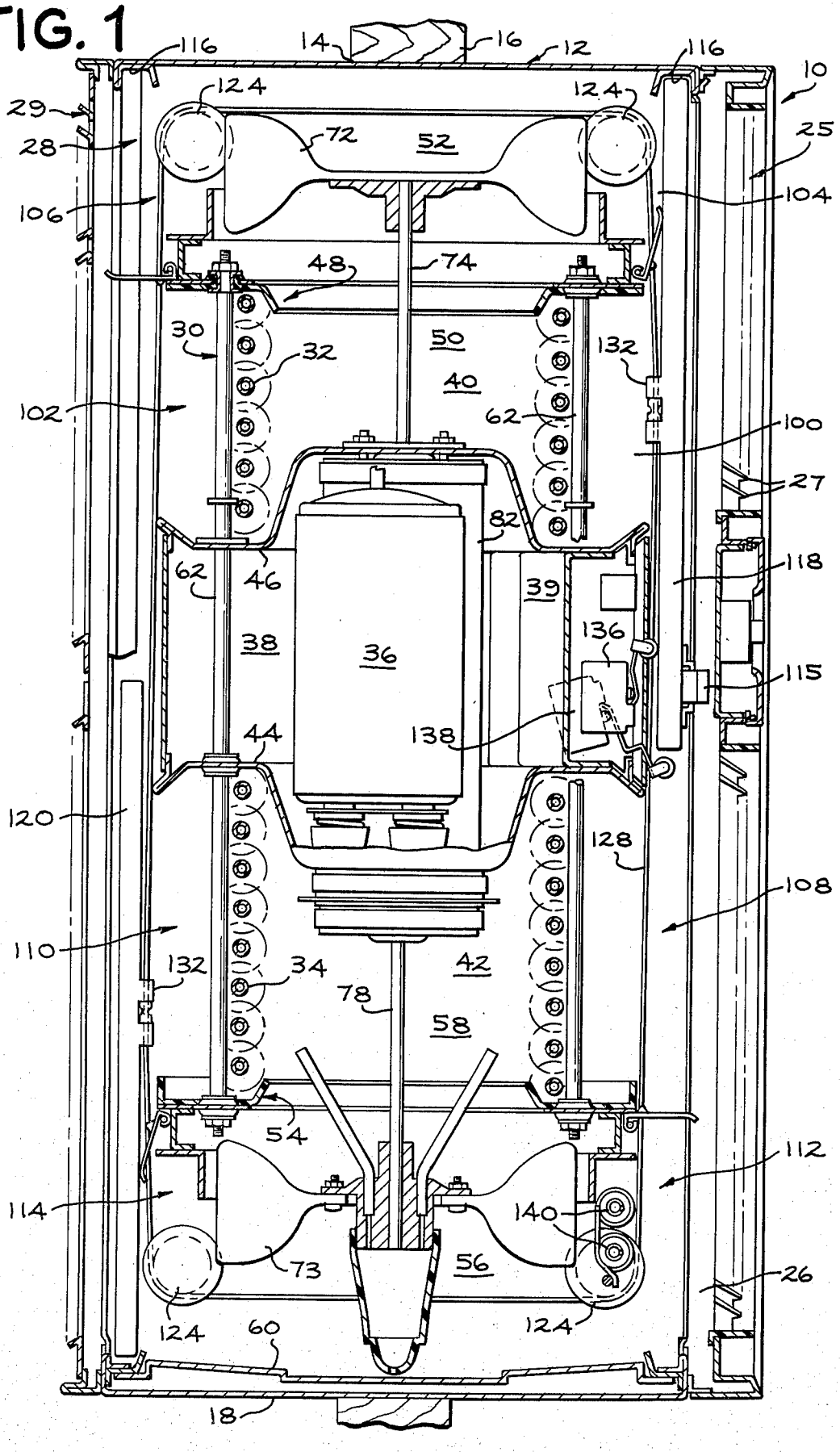
FIG. 1 is a side elevational view in section of the self-contained air conditioning unit incorporating the present invention.

Referring now to the drawings and more particularly to FIG. 1, there is shown an air conditioner unit 10 including a housing 12 that is adapted to be arranged in an opening 14 in the wall 16 of an enclosure to be conditioned. The housing 12 is generally rectangular in shape (FIG. 2) and includes bottom and top walls 18 and 20 respectively interconnected by longer side walls 22 and 24. The housing walls (FIG. 1) define generally a front opening 26 disposed in the enclosure side of wall 16 and a rear opening 28 disposed in the outdoor side of wall 16. Arranged over the front opening 26 of housing 12 is a front grille or appearance member 25 which includes appropriate air deflecting vanes 27, while a grille 29 is positioned over the rear opening 28.

Figure 2:
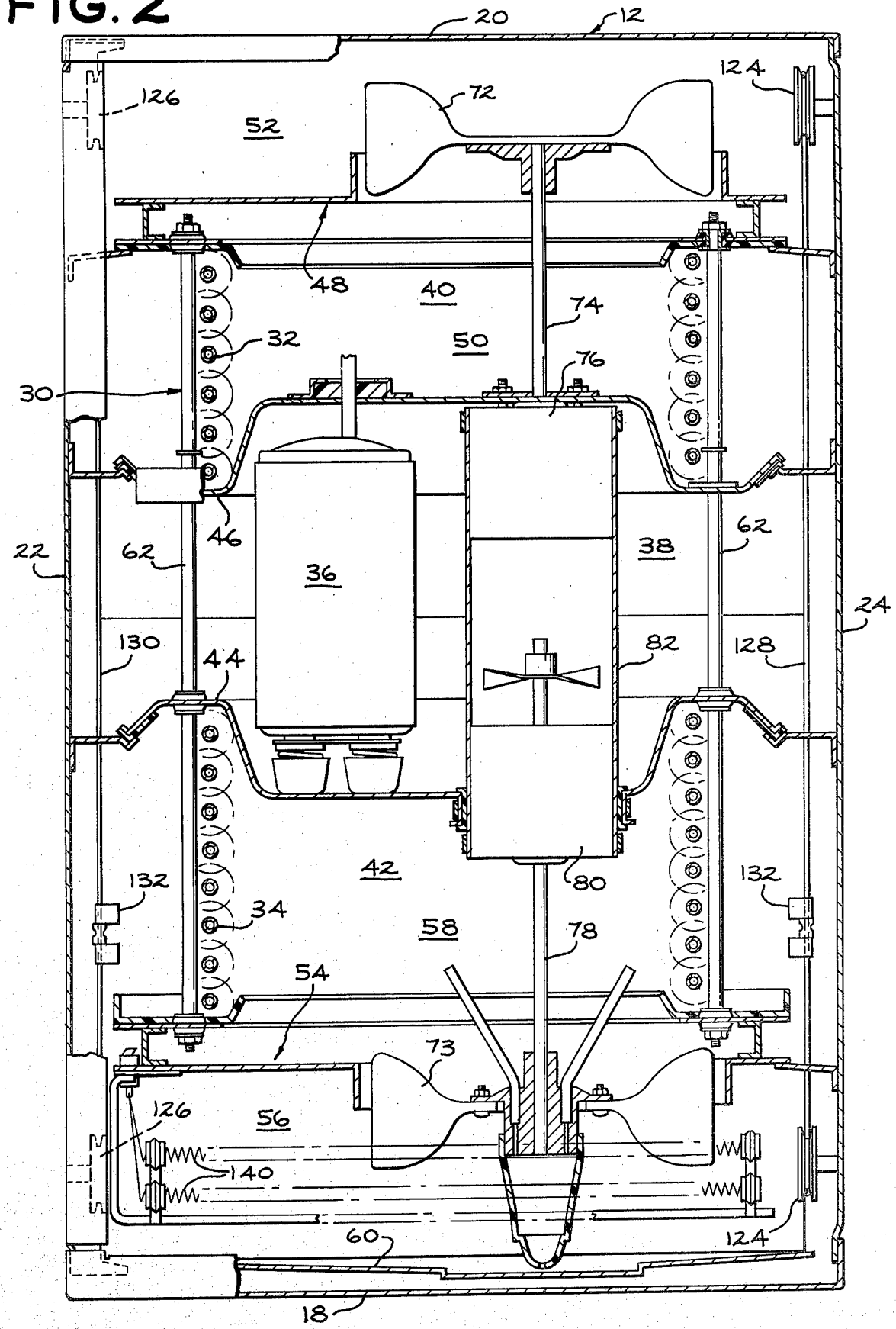
FIG. 2 is a front elevational view partially in section of the self-contained air conditioning unit incorporating the present invention.

Mounted within the housing 12 is a removably arranged chassis 30 on which is mounted an air conditioner refrigeration system including an evaporator 32 and a condenser 34 connected in refrigerant flow relationship with a compressor 36. Referring to FIGS. 1–2, it will be seen that the chassis 30 includes a plurality of parallel spaced partitions that divide the housing 12 in a manner to be explained hereinafter to include a central or machine compartment 38, which houses the compressor 36 and a control box 39, an upper or evaporator compartment 40 and a lower or condenser compartment 42. The partitions of chassis 30 include two spaced substantially parallel central partitions 44 and 46 which define the central compartment 38. And upper fan shroud partition member 48 substantially divides the upper evaporator compartment 40 into an inlet area 50 defined by member 48 and partition 46 and an outlet area 52 defined by member 48 and the upper wall 20 of housing 12. The evaporator 32 is securely held between the partitions 46 and 48 in the inlet area 50. A lower fan shroud partition 54 substantially divides the lower condenser compartment 42 into an outlet area 56 defined by the member 54 and partition 44 and an inlet area 58 defined by member 54 and sump pan 60 arranged in the lower wall 18 of housing 12. The condenser 34 is securely held between the partitions 44 and 54 in the inlet area 58. The partitions are supported in their spaced relationship by a plurality of support members or rods 62.

Air is circulated by a fan 72 arranged in shroud 48 from the evaporator inlet section 50 to evaporator outlet section 52 and similarly air is circulated by a fan 73 arranged in shroud 54 from the condenser inlet 58 to condenser outlet section 56. Fan 72 is mounted on the shaft 74 of a motor 76 while fan 73 is mounted on the shaft 78 of a motor 80.

Referring to FIG. 1, it can be seen that the inlet and outlet sections of the evaporator and condenser compartments are arranged within the rectangular housing 12 with each section having a pair of openings therein, one communicating with opening 28 facing the outdoors, and a second opening communicating with opening 26 facing the enclosure whereby air can be both introduced and discharged from the evaporator and condenser compartments in two different directions. More specifically, the evaporator compartment inlet section 50 contains openings 100 and 102 and the outlet section 52 contains openings 104 and 106 in the indoor and outdoor side respectively of housing 12. Similarly condenser compartment inlet section 58 is provided with openings 108 and 110, and the outlet section 56 is provided with opening 112 and 114 in the indoor and outdoor side respectively of housing 12. As will be hereinafter explained, the inlet and outlet openings of each compartment on the indoor and outdoor side of housing 12 is provided with means for selectively controlling the air flow through the condenser and evaporator compartments.

It should be noted that the evaporator 32 and the condenser 34 are of the spine fin type consisting of one continuous tube member wound spirally so that each heat exchanger is arranged in circular fashion within their respective compartment inlet sections. This configuration is desirable because the inlet openings 100, 102 and 108, 110 leading to their respective sections 50 and 58 are arranged opposite sides thereof and accordingly, the air flows into the sections from opposite directions. That is, by this heat exchanger configuration, it is possible to more efficiently take advantage of all of the space within each of the inlet sections and to utilize the capacity of the heat exchangers to their fullest extent regardless of the direction of air flow.

As may be seen in FIG. 1, the front openings 26 and 28 of housing 12 are provided with channel or track portions 116 that extend completely around the openings. Each opening 26 and 28 is provided with means for controlling air flow through the evaporator and condenser compartments. In the present embodiment, air flow is controlled by a pair of air valves or dampers 118 and 120 that are fitted for vertical movement in the track portions 116 on the openings 26 and 28 respectively.

In the illustrated embodiment of the invention, the dampers are interconnected to insure proper location of one damper over a compartment inlet and outlet opening one side of the housing by movement of the other damper arranged on the other side of the housing. To this end (FIG. 2), there is provided a first set of four rollers 124 rotatably mounted on the side wall 24 of housing 12 and a similar set of four rollers 126 rotatably mounted on the side wall 22 of housing 12. With reference to FIG. 1, it will be seen that the rollers are mounted near the corner portions of the side walls to, in effect, outline a rectangle on each side wall. Arranged on rollers 124 is an endless cable 128, while an endless cable 130 is arranged on the rollers 126. The front damper 118 is secured to each vertical pass of the cables 128, 130 at a point where they communicate with the front opening 26, while the back damper 120 is secured to the cables 128, 130 at a point where they communicate with the rear opening 28. To this end, the dampers are provided with fastening portions 132 located on the vertical edges thereof that is crimped to the cables. Accordingly, vertical movement of the front damper 118 positioned in the enclosure side of housing 12 by the user of the air conditioner will cause an opposite vertical movement of the back damper 120 positioned in the outdoor side of the housing 12.

In use with the dampers 118, 120 arranged in the heating position shown in FIG. 1, the air flow through the conditioner 10 is such as to heat the air circulated from the enclosure. That is in the heating mode with the damper 118 closing the enclosure side inlet opening 100 and outlet opening 104 of evaporator compartment 40, air from the enclosure is drawn into the condenser compartment 42 through inlet 108 where it is passed through the condenser 34 heated and then back into the enclosure through outlet 112. In the heating mode, damper 120 closes the outside inlet openings 110 and outlet opening 114 of the condenser compartment 42 and air from the outdoors is drawn into the evaporator compartment through inlet 102 where it is passed through the evaporator 32 and back into the outdoors through outlet 106.

In the cooling mode, the indoor damper 118 would be positioned by the user of the air conditioner over the enclosure side condenser inlet 108 and outlet 112 section openings so that enclosure air is drawn into the evaporator compartment through uncovered inlet 100 where it is passed through the evaporator and cooled and then back into the enclosure through outlet 104. In this mode the outdoor damper 120 would be positioned over the outdoor evaporator inlet 102 and outlet 106 openings so that outdoor air is drawn into the uncovered condenser compartment 42 through inlet 110 where it is passed through the condenser and then back into the outdoors through outlet 114. To facilitate movement of the indoor damper 118 by the user, there is provided a pair of handles 115, one on each vertical edge.

Control means are provided that prevent operation of the unit in the event the damper doors or air valves are not positioned properly relative to the selected inlet and outlet openings. To this end, there is mounted in the control box 39 a pair of switches 136 and 138. The switch 138 is a heater control switch through which a resistance heater 140 is energized. The switch 138 is moved to its closed position when the damper 118 is in its up position (as shown) and enclosure air is accordingly circulating through the condenser compartment 42. The switch 138 also orients the thermostat 142 so that it functions during the heating cycle between a lower ambient and a higher set temperature. The switch 136 is effective when the damper is in its down or cooling position and enclosure air is accordingly circulating through the evaporator compartment 40. The switch 138 orients the thermostat 142 so that it functions during the cooling cycle between a higher ambient and lower set temperature. Another feature of the switch arrangement is to prevent operation of the air conditioner if both switches are closed. In effect, the switches are so arranged that the damper 118 must be either in its fully up heating position which means damper 120 is in its fully lowered position or in its down position, or cooling position which means damper 120 is in its fully up position.

In the course of this unit operating in the heating mode, water vapor under certain ambient conditions condenses on the evaporator through which as explained hereinbefore outdoor air passes. In some instances, the amount of water vapor available in the outdoor ambient is great enough to solidify and form a layer of ice which blocks air flow through the heat exchanger. This layer of ice must be removed when it has a thickness which opposes the desirable transfer of heat from the heat exchanger. Accordingly, by the present invention, means are provided that permit defrosting and elimination of frost when present in the evaporator each time operator of the system compressor terminates. In its preferred application, the present embodiment of the defrost system is intended to be used in defrosting the evaporator in a manner that will not completely interrupt the heating process of the enclosure air.

Figure 3:
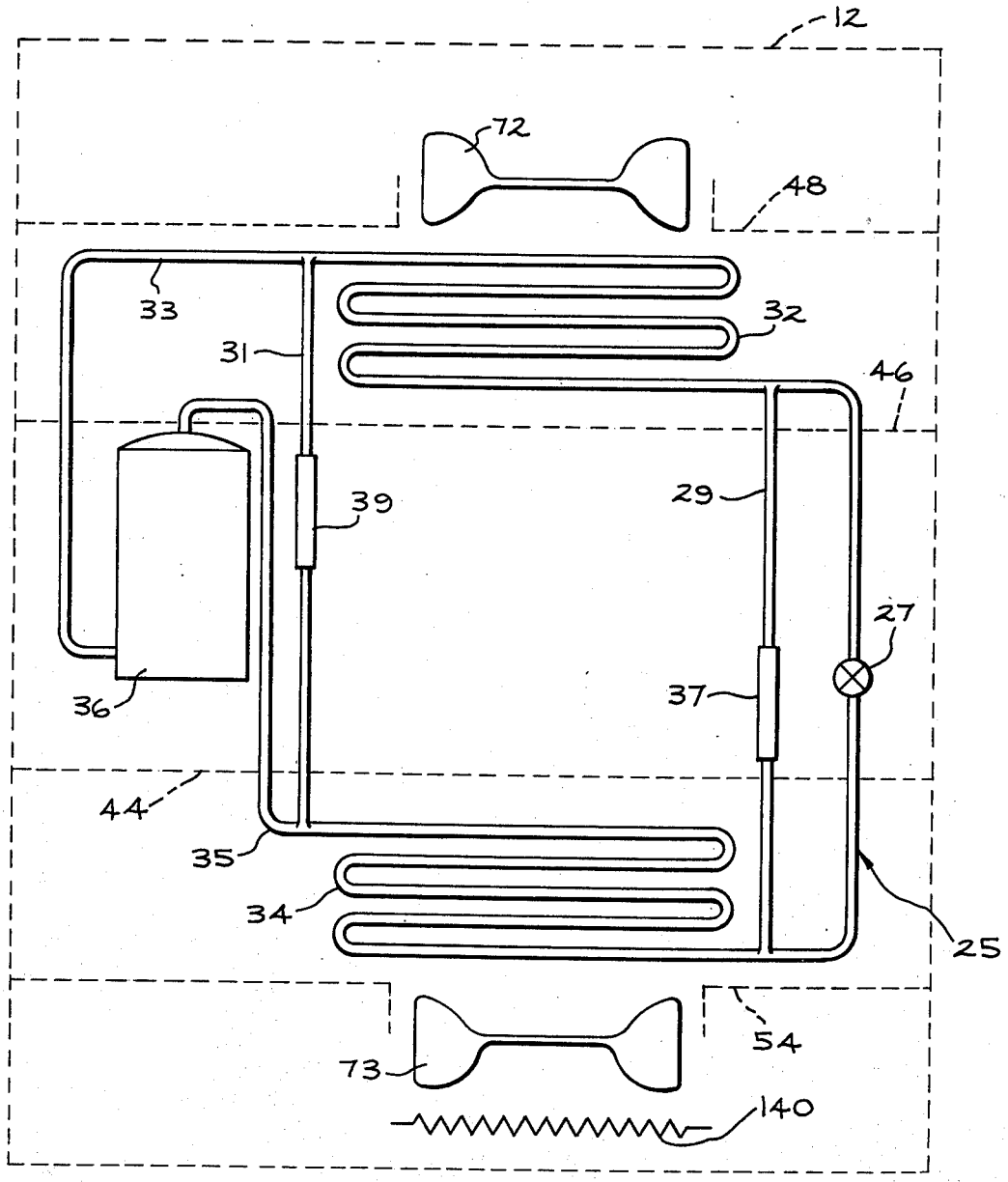
FIG. 3 is a schematic view of the refrigeration system according to this invention.

The means for effecting the defrosting of the evaporator as shown in FIG. 3 of the drawing includes a by-pass line or conduit 29 which is connected between the lower portions of evaporator 32 and condenser 34. In effect, the by-pass 29 is arranged in parallel flow relationship with the system expansion device 27 in the system liquid line 25. A second by-pass line or conduit 31 connected between the upper portion of the evaporator 32 or adjacent suction line 33 and the upper portion of the condenser 34 or adjacent the discharge line 35. In effect, a circuit through line 31 will by-pass the compressor 36. The defrost circuit provided by the present invention is through a closed loop provided by conduits 29, 31 and heat exchangers 32 and 34 with the compressor 36 and expansion device being by-passed. Means are provided to prevent refrigerant flow through either conduit 29 or 31 when the compressor 36 is circulating refrigerant during normal operation of the refrigerating system. To this end, valves 37 and 39 are provided respectively in the conduits 29 and 31.

The valves 37 and 39 are designed to close when a pressure differential is present in the system. Since this pressure differential is created by compressor operation, valves 37 and 39 will remain closed when the system is operating. Accordingly, the added by-pass conduits 29 and 31 and their respective valves 37 and 39 have no effect on the system during its normal operation. Further, the valves are designed to remain closed until after the compressor operation terminates and the system pressure differential created by the operating compressor is fed or bled down through the normal system expansion device 27. At this point, the valves 37 and 39 will open and the by-pass defrost circuit mentioned above is established.

In operation with the unit in the heating mode and a frost condition sensed on the evaporator 32 compressor operation will terminate. At this time, as mentioned above, with the compressor 36 not operating the system pressure differential will bleed down through the system expansion device 27. Accordingly, the valves 37 and 39 being no longer under the influence of the pumped refrigerant flow will move to a neutral or open position and a non-restricted defrost flow path through conduit 29 and 31 between the lower and upper portions of the heat exchangers is established. Hot gaseous phase refrigerant will flow from the upper portion of the condenser 34 through conduit 31 and into the upper portion of the frosted evaporator 32. The liquid refrigerant in the lower portion of the evaporator 32, which is relatively cool, flows through line 29 into the lower portion of the warmer condenser 34 when it is heated and returns to gaseous phase.

The liquid refrigerant accumulated in the frost evaporator 32 will drain into the condenser 34 containing gas due to a gravity head created by the accumulated liqid height and the location of the evaporator above the condenser. The cold liquid at approximately 32° F. in the evaporator will absorb heat from the warm condenser and will change to gas. As liquid drains from the bottom of the evaporator, warm gas will enter the top through conduit 31. This flow of cold liquid out of the bottom of evaporator through conduit 29 to the warm condenser and the flow of warm gas out of the top of the condenser through conduit 31 to the cold evaporator produces an effective defrosting cycle that will continue until the temperature of the evaporator temperature approaches the temperature of the condenser. At this point, gravity flow will terminate because liquid can accumulate in both heat exchangers.

Heat added to the refrigerant during the defrosting comes from the warm condenser which is in a relatively warm ambient in the heating mode. By the present invention, the auxiliary heater 140 together with fan 73 can be employed to provide warm air flow through the condenser 34. While the heater 140 and fan 73 may be energized to provide auxiliary heat during peak demands, it also provides heat to the enclosure during the defrosting operation. The heater function during the defrosting or compressor-off period is effective in maintaining the temperature of the condenser 34 equal to or above the enclosure ambient and, in fact, elevated enough to ensure that the 32° F. liquid refrigerant entering the bottom portion of the condenser is returned to the evaporator through line 31 in gaseous phase.

In summary, the circulation of relatively warm refrigerant in gaseous phase from the condenser 34 into the relatively cold frost-laden evaporator 32 and the simultaneous extraction of the colder refrigerant in liquid phase from the lower portion of the evaporator produces a heat transfer which provides for evaporator defrosting. This free flowing circulation of refrigerant past the system expansion device and compressor continues until the pressure and temperature in the system equalize.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. An air conditioning apparatus for conditioning air in an enclosure having a wall opening comprising:

a housing having openings on opposed sides thereof adapted to be positioned in said wall opening with the opening on one side of said housing facing the outdoors and the opening on the other side of said housing facing said enclosure;

a central chamber defined by spaced partition means dividing said housing into an evaporator compartment and a condenser compartment;

a refrigerator system of the type having a refrigerant capable of boiling under relatively low pressure to absorb heat and condensing under relatively high pressure to expel heat, a compressor for compressing a refrigerant fluid in gasious phase having a high pressure outlet port and a low pressure inlet port, a condenser in said condenser compartment having a high pressure inlet port and a high pressure liquid refrigerant outlet port, means connecting said inlet port to said compressor outlet, an evaporator in said evaporator compartment having a low pressure liquid inlet port in fluid communication with said high pressure liquid refrigerant outlet port of said condenser by a fluid line, and having a low pressure outlet port at its upper portion, means connecting said outlet port with said inlet port of said compressor, and a flow control means in said fluid line;

a fan shroud partition means in each of said compartments substantially dividing said compartments into inlet and outlet sections, each of said sections having an opening in both the indoor and outdoor facing side of said housing; a fan within each of said shrouds for circulating air through each of said compartments in a direction from said inlet section to said outlet section;

a first damper slidably arranged in the indoor facing side of said housing being associated with the indoor facing openings of said compartments; a second damper slidably arranged in the outdoor facing side of said housing being associated with the outdoor facing opening of said compartments; and means for selectively positioning said dampers to a first cooling position wherein the indoor facing openings of said evaporator compartment communicate with the enclosure and the outdoor facing openings of said condenser compartment communicate with said outdoors for cooling the air in said enclosure and to a second heating position wherein the indoor facing openings of said condenser compartment communicate with the enclosure and the outdoor facing openings of said condenser compartment communicate with said outdoors for heating the air in said enclosure.

defrost means including a first defrost flow passage connected between said low pressure outlet port of said evaporator and said high pressure inlet of said condenser; a second defrost flow passage connected between said high pressure outlet of said condenser and said low pressure inlet of said evaporator, a first valve in said first defrost flow passage and a second valve in said second defrost flow passage;

said first and second valves being operable to a closed position when a refrigerant pressure differential is present in said system and being operable to an open position when said pressure differential is bled down through said flow control means after said compressor operation terminates, so that a nonrestrictive refrigerant defrost flow path circuit is established through said first defrost flow passage between the upper portions of said condenser and said evaporator and through said second defrost flow passage between the lower portion of said condenser and said evaporator, thereby allowing liquid refrigerant when present in the lower portion of said evaporator to flow through said second defrost flow passage into the lower portion of said condenser, while the warmer gaseous refrigerant when present in the condenser will flow through said first defrost flow passage into the upper portion of said evaporator to lower the temperature of said evaporator and melt frost when present.

2. The air conditioning apparatus recited in Claim 1 wherein said evaporator and said condenser are of the spine fin type consisting of one continuous tube member spirally so that each heat exchanger is arranged in circular fashion around the fan shroud partition within their respective compartments.

3. The air contitioning apparatus recited in Claim 2 further including means for directing moisture from said evaporator to the stream of air passing through the condenser for evaporation thereon.

4. The air conditioning apparatus recited in Claim 3 wherein said means for directing moisture includes a sump member arranged below said condenser for collecting moisture from said evaporator, a pump member mounted on the hub portion of said condenser fan for rotational movement therewith, said pump member having a diameter which gradually increases from the bottom to the top with the lowermost portion being arranged in said sump so as to be submersed in said moisture when present, an aperature in the lower portion of said pump member communicating with the interior thereof, passageways in said hub portion extending axially therethrough having one end in communication with the interior of said pump member, tube members arranged in the upper openings of said passageways extending upwardly and outwardly interiorly of said spirally wound condenser so the centrifugal force will lift moisture from said pump when present and cause it to be thrown against the relatively warm interior surface of said condenser.

* * * * *